US009278388B2

(12) United States Patent
Martinsson

(10) Patent No.: US 9,278,388 B2
(45) Date of Patent: Mar. 8, 2016

(54) PROCESS FOR THE MANUFACTURING OF A THIN-WALLED ARTICLE IN METAL

(71) Applicant: Metallfabriken Ljunghall AB, Sodra Vi (SE)

(72) Inventor: Mikael Martinsson, Sodra Vi (SE)

(73) Assignee: METALLFABRIKEN LJUNGHALL AB, Sodra Vi (SE)

( * ) Notice: Subject to any disclaimer, the term of this patent is extended or adjusted under 35 U.S.C. 154(b) by 0 days.

(21) Appl. No.: 14/440,529

(22) PCT Filed: Nov. 26, 2013

(86) PCT No.: PCT/SE2013/000185

§ 371 (c)(1),
(2) Date: May 4, 2015

(87) PCT Pub. No.: WO2014/084770

PCT Pub. Date: Jun. 5, 2014

(65) Prior Publication Data

US 2015/0273575 A1 Oct. 1, 2015

(30) Foreign Application Priority Data

Nov. 29, 2012 (SE) ..... 1200733

(51) Int. Cl.

| | |
|---|---|
| ***B22C 9/10*** | (2006.01) |
| ***B22C 9/06*** | (2006.01) |
| ***B22D 17/22*** | (2006.01) |
| ***B22D 29/00*** | (2006.01) |
| ***B22D 25/00*** | (2006.01) |

(52) U.S. Cl.

CPC ..... *B22D 17/2236* (2013.01); *B22C 9/064* (2013.01); *B22C 9/103* (2013.01); *B22D 17/229* (2013.01); *B22D 25/00* (2013.01); *B22D 29/001* (2013.01)

(58) Field of Classification Search

CPC .... B22C 9/103; B22C 9/064; B22D 17/2236; B22D 17/229; B22D 29/001

USPC ..... 164/132, 302, 345, 346

See application file for complete search history.

(56) References Cited

U.S. PATENT DOCUMENTS

| | | | | |
|---|---|---|---|---|
| 2,948,031 A * | 8/1960 | Webb | B22D 15/02 | 164/340 |
| 5,090,888 A * | 2/1992 | Pfannkuchen | B22D 17/22 | 164/303 |
| 6,827,126 B2 * | 12/2004 | Niimi | B22D 17/007 | 164/340 |
| 8,226,404 B2 * | 7/2012 | Sorimoto | B22D 17/2236 | 425/438 |

* cited by examiner

*Primary Examiner* — Kevin E Yoon

(74) *Attorney, Agent, or Firm* — Novak Druce Connolly Bove + Quigg LLP

(57) ABSTRACT

A process for the production of a thin walled metal detail (4) with an undercut (2), whereas a mold (1) is equipped with a first mold half (10) and a second mold half (20), characterized in that the first mold half (10) is equipped with a core (10*a*) and moveable core (11) the latter giving shape to said undercut (2) wherein, a) the mold (1) in the closed position is filled with metal melt allowed to set after which, b) the mold is (1) opened by withdrawing the second mold half (20) at which, c) the moveable core (11) is pushed out in unison with at least one ejector pin hereby ejecting the metal detail (4) from the mold (1) whereupon, d) the metal detail (4) is removed from the moveable (11) core.

13 Claims, 3 Drawing Sheets

PROCESS FOR THE MANUFACTURING OF A THIN-WALLED ARTICLE IN METAL

BACKGROUND OF THE INVENTION

1. Field of the Invention

Figure 1:
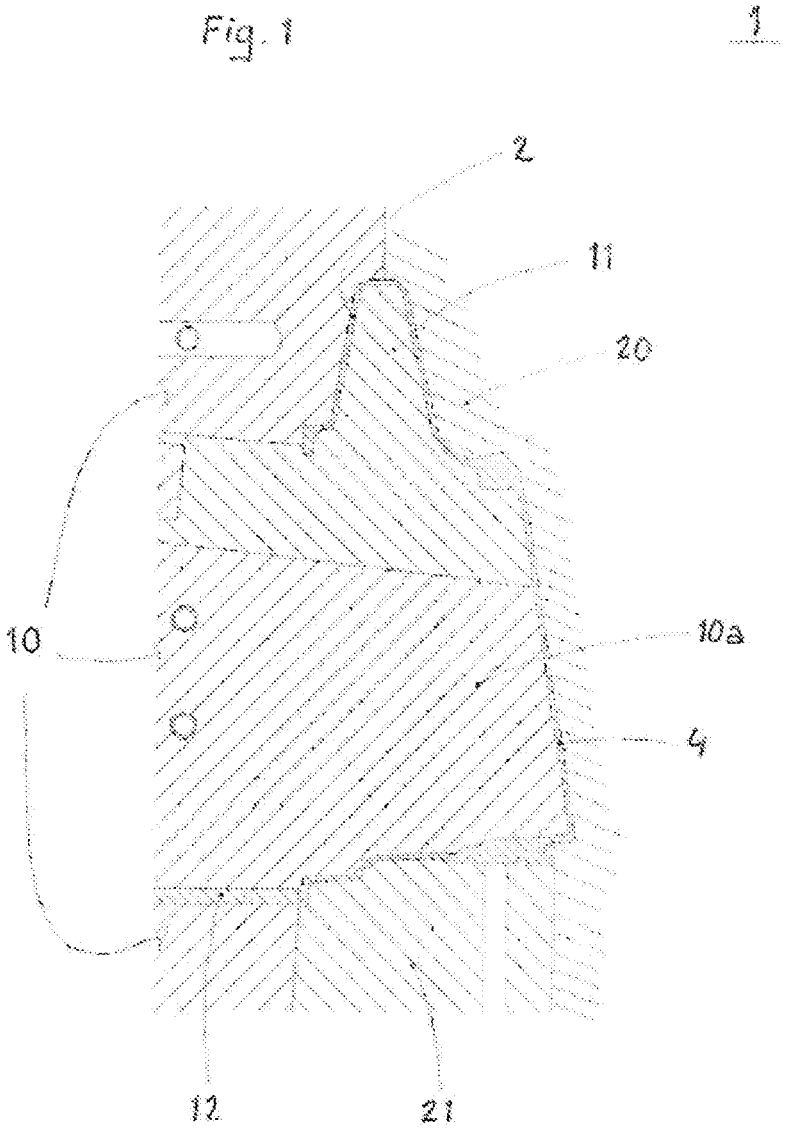

The present invention relates to a process for the manufacture of die cast thin-walled details of metal and a device in a mold adapted thereto.

2. Description of Known Technology

Die cast metal parts are commonly used today. These are used in many different areas where there are high demands for low weight, function and precision. Details obtained through ingot casting need to be extensively processed after casting to achieve the desired precision. Such details also need fairly thick goods to ensure complete filling of the mold cavity since no pressure can be applied. The latter increases the weight of finished work piece weight which is not desirable. Also inner volumes of articles intended to have a certain capacity is reduced. Injection molding of for example aluminum makes it possible to utilize so called rheo-casting which provides higher homogeneity and reduced risk of forming pores in the molded goods. Injection molding of aluminum is performed in the temperature range 670-720° C. High pressures are used to produce thin-walled parts in particular when utilizing rheo-casting. This implies that high demands on the sealing planes in the mold as the melt has low viscosity and easily creeps into the partition plan. Traditionally, it has therefore been considered impossible to design injection molded details with collapsing core as this would greatly reduce the life expectancy of the mold.

One way known in the art is to utilize separate cores for providing undercuts. These separate cores are assembled into the mold prior to molding and is after the molding pried or knocked out of the molded part. There are several problems with this known method.

First of all, the molded part will shrink onto the separate core and the release angle will therefore have to be rather large, typically in excess of 5°. This will of course limit the practical use of making undercuts.

Secondly the cycle time will increase as the mold will have to be assembled before each molding.

Thirdly the separate cores will be damaged due to all the handling especially when the separate cores are knocked out of the molded part. This will affect the sealing of the mold and consequently limit the useful life of the mold itself.

Fourth, the mold temperature is very important for the quality of the molded detail and there is no practical way to temper the separate cores prior to, as well as during the molding cycle.

Fifth, the use of separate cores will also increase the need for post molding treatment as the inevitable dents on sensitive edges of the separate cores, which are intended to form sealing planes in the mold will cause so called burrs and flash.

Sixth, the knocking and prying operation to remove the separate cores from the molded part will increase the risk for damaging not only the separate core but also the part itself. Small cracks or fissures not unlike those related to as metal fatigue can occur which leads to a need for substantial testing of molded parts with serious functions such as certain critical vehicle components.

Seventh, the separate cores need to be fixed in their proper position during the molding which calls for one or more support pins arranged at the opposite side of the mold. These support pins will leave holes in the molded part and these holes will in most cases have to be plugged after molding.

Eight, all of the above listed problems will inevitably lead to a substantial cost increase for the molded articles due to increased handling, longer cycle times, shorter life expectancy of the molds, increased amount of rejected articles, lower average quality of molded parts, increased testing to assure quality and finally increased work effort on each molded part.

SUMMARY OF THE INVENTION

The invention accordingly relates to a process for the production of a thin walled metal detail with an undercut. A mold is equipped with a first mold half and a second mold half. The invention is characterized in that the first mold half is equipped with a core and moveable core the latter giving shape to said undercut wherein, a) the mold in the closed position is filled with metal melt allowed to set after which, b) the mold is opened by withdrawing the second mold half at which, c) the moveable core is pushed out in unison with at least one ejector pin hereby ejecting the metal detail from the mold whereupon, d) the metal detail is removed from the moveable core.

According to one embodiment of the invention the molten metal in the form of aluminum is injected into the mold cavity in step a) above. The temperature of the molten metal is in the range 670-720° C. while the pressure is in the range 700-1000 bar.

The mold is advantageously further provided with at least one ejector pin which is pushed out in unison with the moveable core in procedure step c) and which is withdrawn before procedure step d). Traditionally, injection molded articles are removed in the opening direction of the mold. According to one embodiment of the invention, the molded metal detail is removed from the moveable core in a mainly straight angle towards the opening direction of the mold. This is suitable achieved by means if a robot which then will act as an extension of the ejection system of mold. In cases where the space between the mold halves in an open mold is limited, the metal detail can be removed through a curving motion which advantageously is achieved through means of said robot.

According to a preferred embodiment of the invention the moveable core is so arranged so as to move at an angle $\alpha^I$ from the at least one ejector pin so that the relative position between an inner face of the undercut and a corresponding shaping face of the moveable core is increased as the metal detail is ejected from the mold.

According to one embodiment of the invention the mold is further provided with at least one retractable mold side for the molding of functional parts of an outside of the thin walled metal detail. The retractable mold side or the retractable mold sides is opened before process step c).

The moveable core is suitable moveably attached to an ejector plate. A second ejector plate is then suitably arranged to achieve separate movement of the ejector pins. It will hereby be made possible to retract the ejector pins after the ejection of the molded metal detail in order to increase the accessibility for removal of the metal detail from the mold.

The moveable core is advantageously provided with interior channels for cooling media. This will allow a better temperature profile in the mold so that shorter cycle times, less stress built in to the material of the metal detail and smother operation of the mold which in turn leads to longer life span of the mold itself, is achieved.

According to a preferred embodiment of the invention the first mold half is provided with a release surface arranged on at least one side of moveable core. Said release surface have a release angle $\alpha^{II}$ smaller than the angle $\alpha^{I}$ whereby the undercut is rapidly released from the moveable core.

The undercut is accordingly released from the moveable core in connection to the ejection of the metal detail.

According to one embodiment of the invention at least one of the at least one ejector pins is utilized for obtaining at least one depression. Said at least one depression in co-operation with said at least one ejector pin is then utilized for guiding the direction of the ejection. The direction of ejection and the opening direction of the moveable core are diverging.

According to one embodiment of the invention the time from mold opening (step b)) to initiation of ejection (step c)) is shorter than 18 seconds.

The ejection (step c) is suitably initiated at a temperature higher than Δ wherein Δ is ½ the temperature difference between ambient temperature (23° C.) and the setting or solidification temperature of the injected metal. There is a great advantage by rapidly releasing the undercut from the moveable core. All metals will expand with elevated temperatures and opposite shrink as the temperature is lowered. This means that if allowed to cool too much, the metal detail will shrink and sit very hard onto the moveable core. In fact it may sit so hard on the moveable core that it would virtually impossible to remove it without destroying either the part itself or the mold. In fact, the stress may be so big that stress fractures in the metal detail may appear. As previously discussed, the release angle will have to be adapted to this shrinkage and with previously known methods this release angle would have to been set at 5° or more. During trials with the herein disclosed invention, a release angle of only 1.5° in the undercut has been tried with great success.

According to one embodiment of the invention a material inlet is so arranged so that the molten metal exerts a pressure towards the moveable core (11) so that this is pressed towards the core (10*a*). The risk for leakage in the parting plane between the core (10*a*) and the moveable core (11) is hereby limited. Suck leakages will otherwise cause so called flash or burrs which need to be removed through unwanted post works. Leakages will also limit the useful life of the mold through increased wear.

According to an alternative embodiment of the invention flow channels are so arranged so that the molten metal exerts a pressure towards the moveable core (11) so that this is pressed towards the core (10*a*) wherein the risk for leakage in the parting plane between the core (10*a*) and the moveable core (11) is limited in the same as described above. The same problems as described above is accordingly are avoided also with this method.

It can also be advantageous to include a cleaning step before closing the mold for next molding cycle. This can for example be performed by blowing a fluidum under high pressure so adapted as to remove undesired particles, chips and burrs from sensitive functional surfaces of the mold. The fluidum may comprise a gas such as air possibly with small amounts of lubricants and/or water.

The invention accordingly comprises a mold for the manufacturing of a thin-walled metal detail having an undercut. The mold is accordingly provided with a first mold half and a second mold half. The first mold half is equipped with a core and moveable core the latter giving shape to said undercut. The moveable core is pushed out in unison with at least one ejector pin hereby ejecting the metal detail from the mold. The at least one ejector pin which is pushed out in unison with the moveable core is then suitable withdrawn before removing the metal detail from the mold.

The mold is then provided with a material inlet and/or flow channel so arranged so that the molten metal exerts a pressure towards the moveable core so that this is pressed towards the core wherein the risk for leakage in the parting plane between the core and the moveable core is limited.

According to one embodiment of the invention the mold is further provided with at least one retractable mold side for the molding of functional parts of the thin-walled metal detail outside. The retractable mold side or the retractable mold sides is then opened before the moveable core and ejector pins are ejecting the metal detail. The moveable core is preferably so arranged so as to move at an angle $\alpha^{I}$ from the at least one ejector pin so that the relative position between an inner face of the undercut and a corresponding shaping face of the moveable core is increased as the metal detail is ejected from the mold.

The first mold half is preferably provided with a release surface arranged on at least one side of moveable core. Said release surface has a release angle $\alpha^{II}$ smaller than the angle $\alpha^{I}$ whereby the undercut is rapidly released from the moveable core.

DESCRIPTION OF AN EMBODIMENT EXAMPLE

FIG. 1 shows in cross-section a closed mold 1

Figure 1B:
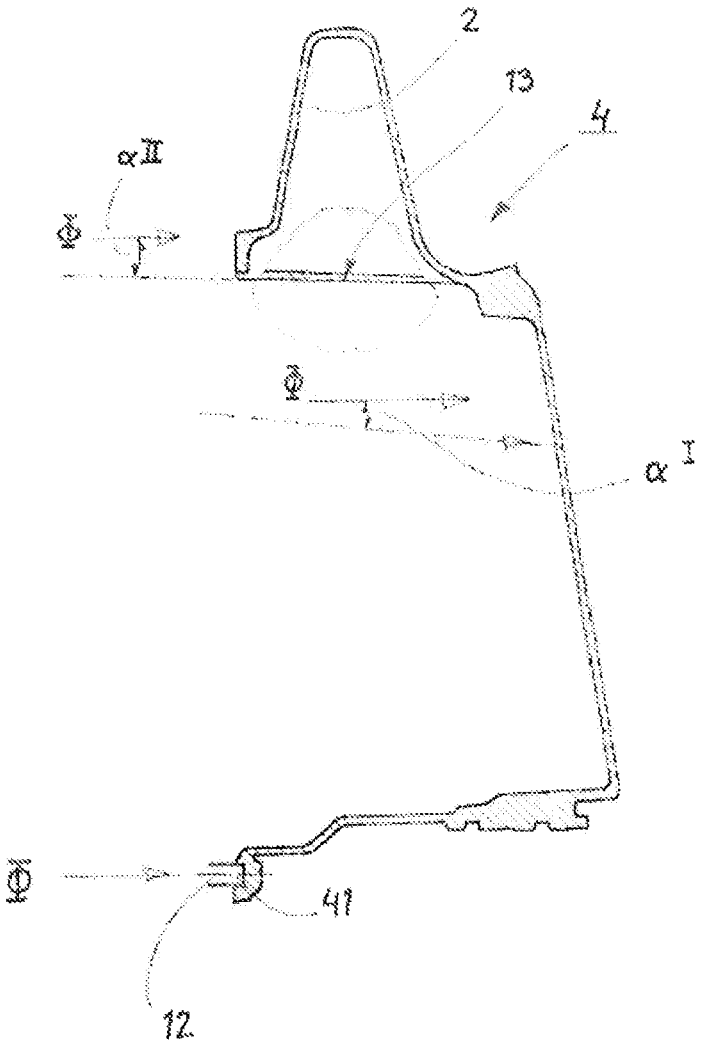

FIG. 1*b* shows in cross-section a metal detail 4.

Figure 2:
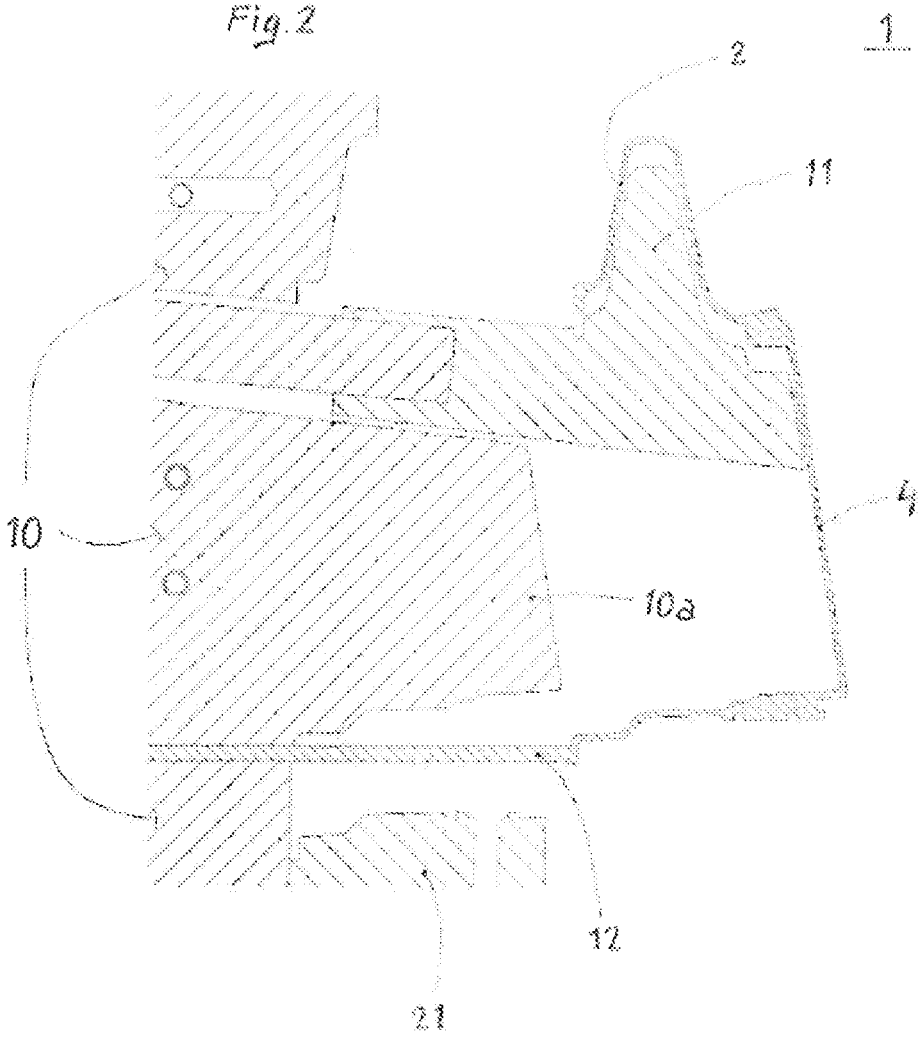

FIG. 2 shows in cross-section an opened mold 1.

Accordingly, FIG. 1 show a mold 1 used in a process for the production of a thin walled metal detail 4 with an undercut 2. The mold 1 is equipped with a first mold half 10 and a second mold half 20. The first mold half 10 are equipped with a core 10*a* and moveable core 11, the latter giving shape to said undercut 2. The second mold half 20 is further provided with a retractable mold side 21 for the molding of functional parts of the thin-walled metal detail 4 outside wherein, a) the mold 1 in the closed position is filled with metal melt allowed to set after which, b) the mold is 1 opened by withdrawing the second mold half 20 and moving the retractable mold side 21 to the side at which, c1) the moveable core 11 is pushed out in unison with at least one ejector pin 12 hereby ejecting the metal detail 4 from the mold 1 whereupon, c2) the ejector pin 12 d) the metal detail 4 is removed from the moveable 11 core in direction perpendicular to the opening direction Φ (see FIG. 1*b*) of the mold 1. It is suitable to utilize a robot for picking the metal detail 4 from the moveable core 11. The mold 1 can then be closed and a new production cycle can commence.

The moveable core 11 is so arranged so as to move at an angle $\alpha^{I}$ (see FIG. 1*b*) from the ejector pin 12 so that the relative position between an inner face 21 of the undercut 2 and a corresponding shaping face 11A of the moveable core 11 is increased as the metal detail 4 is ejected from the mold 1.

The first mold half 10 is provided with a release surface 13 arranged on at least one side of moveable core 11. Said release surface 13 (see FIG. 1*b*) has a release angle $\alpha^{II}$ (see FIG. 1*b*) smaller than the angle $\alpha^{I}$ whereby the undercut 2 is rapidly released from the moveable core 11. The undercut 2 is accordingly released from the moveable core 11 in connection to the ejection of the metal detail 4.

FIG. 1*b* shows the metal detail 4 in cross section, so that a portion located behind the cross section is also visible. The undercut 2 is accordingly not extending over the full length of the metal detail 4.

The invention is not limited by the embodiment shown as it can be varied in different ways within the scope of the invention. A material inlet and/or flow channels can for example be arranged so that the molten metal exerts a pressure towards the moveable core 11 so that this is pressed towards the core 10*a* wherein the risk for leakage in the parting plane between the core 10*a* and the moveable core 11 is limited.

At least one of the ejector pins 12 can also be utilized for obtaining a depression 41 (see FIG. 1*b*). Said depression 41 can in co-operation with the ejector pin 12 be utilized for guiding the direction Φ of the ejection. The direction Φ of ejection and the opening direction of the moveable core 11 are diverging. A release surface 13 as shown in FIG. 1*b* can also be arranged on both sides of the undercut 2 i.e. both in front of as well as behind the cross-section of FIG. 1*b*.

I claim:

1. A process for the production of a thin walled metal detail (4) with an undercut (2), whereas a mold (1) is equipped with a first mold half (10) and a second mold half (20), characterized in that the first mold half (10) is equipped with a core (10*a*) and moveable core (11) the latter giving shape to said undercut (2) wherein, a) the mold (1) in the closed position is filled with metal melt allowed to set after which, b) the mold is (1) opened by withdrawing the second mold half (20) at which, c) the moveable core (11) is pushed out in unison with at least one ejector pin hereby ejecting the metal detail (4) from the mold (1) whereupon, d) the metal detail (4) is removed from the moveable (11) core.

2. A process according to claim 1, characterized in that the at least one ejector pin (12) which is pushed out in unison with the moveable core (11) in procedure step c) is withdrawn before procedure step d).

3. A process according to claim 1, characterized in that the moveable core (11) is so arranged so as to move at an angle αI from the at least one ejector pin (12) so that the relative position between an inner face (21) of the undercut (2) and a corresponding shaping face (11A) of the moveable core (11) is increased as the metal detail (4) is ejected from the mold (1).

4. A process according to claim 1, characterized in that the mold (1) is further provided with at least one retractable mold side (21) for the molding of functional parts of the thin-walled metal detail (4) outside the retractable mold side (21) or the retractable mold sides (21) is opened before process step e).

5. A process according to claim 1, characterized in that the moveable core (11) is moveably attached to an ejector plate.

6. A process according to claim 1, characterized in that the moveable core (11) is provided with interior channels for cooling media.

7. A process according to claim 1, characterized in that the first mold half (10) is provided with a release surface (13) arranged on at least one side of moveable core (11), said release surface (13) having a release angle αII smaller than the angle αI whereby the undercut (2) is rapidly released from the moveable core (11).

8. A process according to claim 7, characterized in that the undercut (2) is released from the moveable core (11) in connection to the ejection of the metal detail (4).

9. A process according to claim 1, characterized in that at least one of the at least one ejector pins (12) is utilized for obtaining at least one depression (41), that said at least one depression (41) in co-operation with said at least one ejector pin (12) is utilized for guiding the direction Φ of the ejection, that the direction Φ of ejection and the opening direction of the moveable core (11) are diverging.

10. A process according to claim 1, characterized in that the time from mold opening (step b)) to initiation of ejection (step c)) is shorter than 10 seconds.

11. A process according to claim 1, characterized, in that the ejection (step c)) is initiated at a temperature higher than Δ wherein Δ is ½ the temperature difference between ambient temperature (23° C.) and the setting or solidification temperature of the injected metal.

12. A process according to claim 1 wherein a material inlet is so arranged so that the molten metal exerts a pressure towards the moveable core (11) so that this is pressed towards the core (10*a*) wherein the risk for leakage in the parting plane between the core (10*a*) and the moveable core (11) is limited.

13. A process according to claim 1 wherein flow channels are so arranged so that the molten metal exerts a pressure towards the moveable core (11) so that this is pressed towards the core (10*a*) wherein the risk for leakage in the parting plane between the core (10*a*) and the moveable core (11) is limited.

* * * * *